US006017487A

United States Patent [19]

Fish

[11] Patent Number: 6,017,487

[45] Date of Patent: Jan. 25, 2000

[54] LID OF PREFORMED REFRACTORY MATERIAL FOR METALLURGICAL MELTING FURNACE

[75] Inventor: George L. Fish, LeClaire, Iowa

[73] Assignee: Aluminum Company of America, Pittsburgh, Pa.

[21] Appl. No.: 08/158,853

[22] Filed: Nov. 29, 1993

Related U.S. Application Data

[63] Continuation-in-part of application No. 07/814,689, Dec. 30, 1991, abandoned.

[51] Int. Cl.[7] ..... C21B 7/02

[52] U.S. Cl. ..... 266/283; 432/250; 52/604; 266/286

[58] Field of Search ..... 266/199, 280, 266/283, 286, 275; 432/250; 52/604, 605

[56] References Cited

U.S. PATENT DOCUMENTS 1,524,033 1/1925 Hawke ..... 432/250
3,434,263 3/1969 Beckman et al. ..... 52/715

*Primary Examiner*—Scott Kastler
*Attorney, Agent, or Firm*—Jones, Tullar & Cooper, P.C.

[57] ABSTRACT

A lid for a melting furnace includes preformed refractory side panels in the form of circular sectors and a center panel in the form of a circular or octagonal closure. The side panels are inclined upward and inward from support provided by a lid ring encircling the lid. The center panel is horizontal. The edges of the panels are according to one embodiment beveled to mutually support one another and contain keyways filled with keys that structurally interconnect the panels. The side panels may include a plurality of blocks with step portions for mutual engagement between a corresponding skewback and the center panel.

24 Claims, 8 Drawing Sheets

FIG. 6
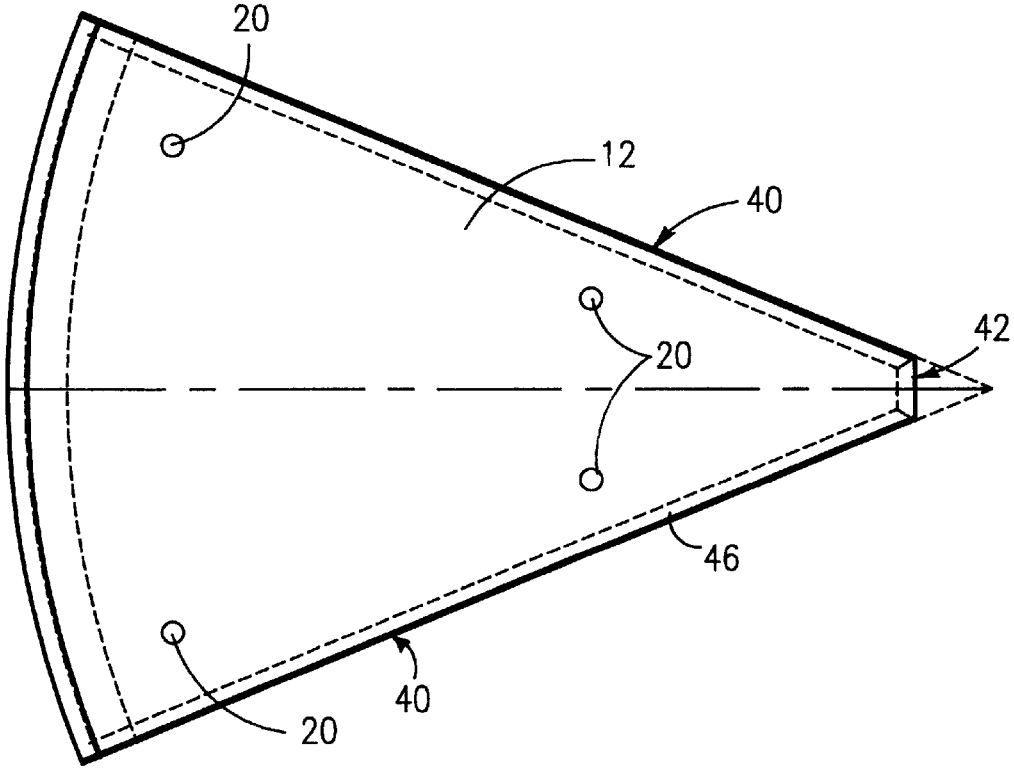
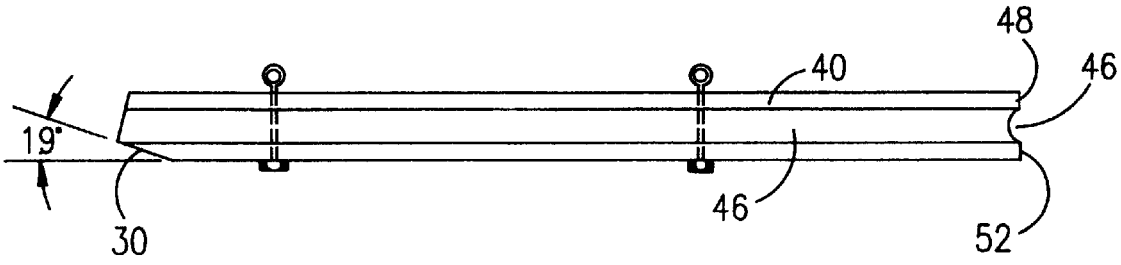
FIG. 7

FIG. 8
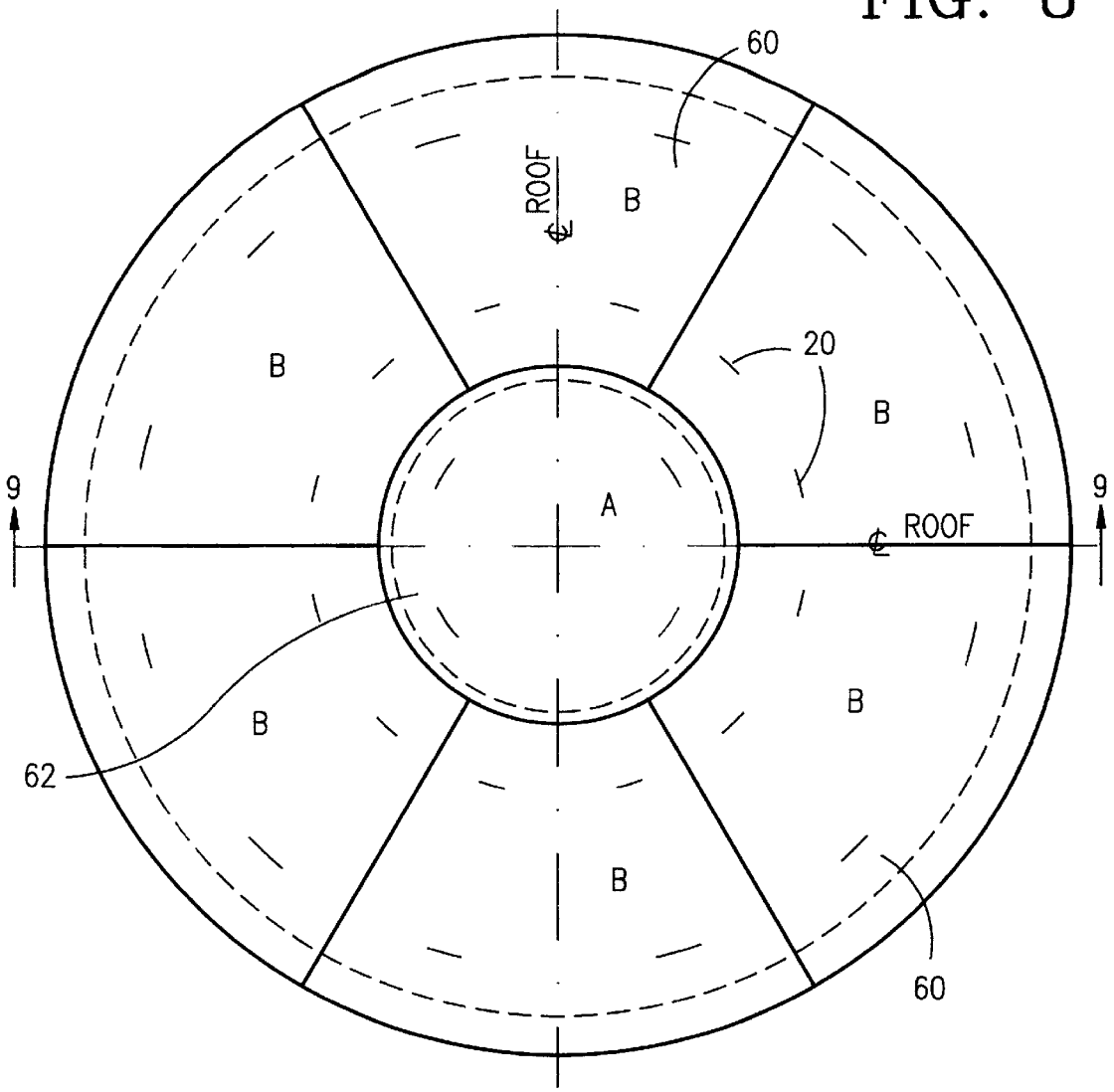
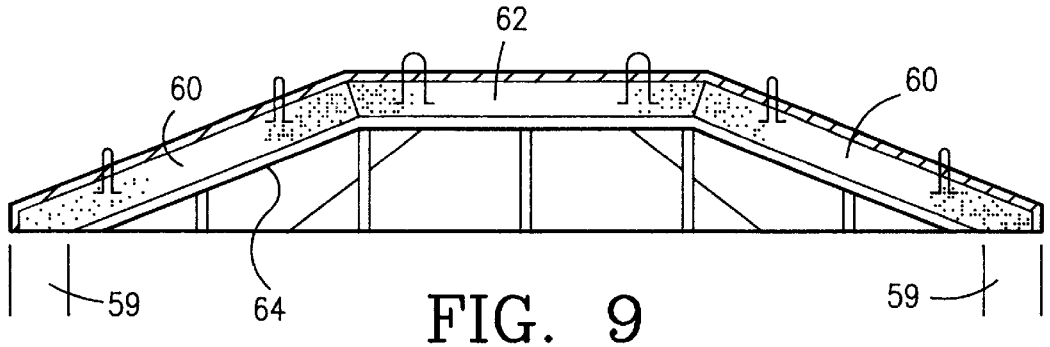
FIG. 9

LID OF PREFORMED REFRACTORY MATERIAL FOR METALLURGICAL MELTING FURNACE

CROSS-REFERENCE TO RELATED APPLICATION

This application is a Continuation-in-part of application, Ser. No. 07/814,689, filed Dec. 30, 1991, now abandonded.

BACKGROUND OF THE INVENTION

1. Field of the Invention

This invention relates to the field of melting furnaces for metal production. More particularly it pertains to a roof or lid assembly for such furnaces formed of refractory material and in relatively large segments assembled during construction.

2. Description of the Prior Art

It is conventional practice to fabricate the roof of round, top-charged melting furnaces using many interlocking refractory bricks. For a typical furnace having a diameter of 26 feet, approximately 6500 bricks in four shapes are required. As the roof is formed, the diameter of each row of bricks is reduced, therefore requiring a different brick shape to produce a near perfect fit. Each brick is individually mortared and placed by hand; a long, labor intensive process. However, because of the large number of brick shapes required to produce a perfect fit, a lesser number is used to produce a reasonably acceptable, less perfect fit. Furthermore, the various brick shapes are difficult and costly to produce.

Top overcome these and other problems, various techniques employing larger building units than bricks have been devised. For example, U.S. Pat. No. 4,021,603 describes a domed furnace roof assembled from panels of cast iron having an embedded cooling coil for carrying cooling water. A central panel closes the roof surface, which is bounded by a circumferential ring. U.S. Pat. No. 4,453,253 describes use of wedge-shaped refractory roof blocks arranged to extend between a furnace wall and a polygonal center panel to form a domed roof.

The U.S. patent to Kramer (U.S. Pat. No. 3,621,627) describes a refractory grid of panels whose radially directed, adjacent edges are alternately beveled inwardly downward and outwardly downward, thereby interlocking the panels.

U.S. Pat. No. 3,434,263 shows a technique for forming a grout key in recesses at the faces of precast concrete blocks. The keys form a shear connection between the blocks. The U.S. patent to Watry (U.S. Pat. No. 4,147,009) shows a recessed keyway filled with mortar to join precast panels. U.S. Pat. No. 2,465,822 describes a furnace lid of wedge-shaped refractory elements, whose adjacent faces are held in place by a peripheral band.

SUMMARY OF THE INVENTION

It is an object of this invention to provide a roof for a metallurgical melting furnace that is fabricated from large segments of pre-formed refractory material, mutually interconnected at the site where the roof is constructed. It is a further object of this invention to provide members for a furnace roof that can be assembled in large sections easily, in a short amount of time and at low cost.

The assembled roof of cast refractory has, according to one embodiment, the shape of a right circular truncated cone comprising side panels and a center panel. Each side panel is in the form of an inclined circular sector having a radially inner edge that connects the radial edges of the panel. The radially inner edge of each side panel, in one form, is a straight line, whereupon a central polygonal panel closes the roof. In another form, the radially inner edge of each side panel is a circular arc, whereupon a central circular panel closes the roof. Edges of the side panels and center panel are beveled in relation to the plane of the corresponding panel so that the edges are in abutting contact with corresponding edges of the adjacent panels. The side panels are inclined upward toward the center, fill the circular planform of the roof except for the center panel, and rest on neighboring side panels in dome-like fashion. The center panel is substantially horizontal and rests upon beveled edges of the side panels at their inner periphery.

According to another embodiment of the present invention, the roof has the shape of an arch formed by a build-up of curved segments in each sector, each segment being positively engaged to its adjacent segments.

In either case, the roof is supported horizontally at its periphery on the top of the side walls of the furnace and is supported radially by bearing against a lid ring, a structural I-beam that encircles the lid. The keys are cast in place of precast refractory at the furnace site after adjacent side panels are set in position. The center panel is precast and lifted by, for example, a crane, to its proper location.

Each side panel and the center panel preferably include a lifting rod embedded in the refractory, by which the panel is held from a cable supported on a crane or other lifting device so the panel can be moved to and lowered into position at the top of the furnace walls. During assembly, the side and center panels are supported vertically by a supporting scaffold or framework until the panels are interconnected structurally by casting the center panel among the side panels and casting keys in the keyways. Thereafter the framework is removed and the roof is supported vertically on the furnace walls and radially by the lid ring.

These objects and other objects, features and advantages of the invention are readily apparent from the following detailed description of the best mode for carrying out the invention when taken in connection with the accompanying drawings.

BRIEF DESCRIPTION OF THE DRAWINGS

FIG. 6 is a plan view of a side panel.

FIG. 7 is a side view of the side panel of FIG. 6.

FIG. 8 is a plan view of another furnace lid according to this invention showing side panels and a center panel.

FIG. 9 is a cross section taken at plane 9—9 of FIG. 8.

DESCRIPTION OF THE PREFERRED EMBODIMENTS

Figure 1:
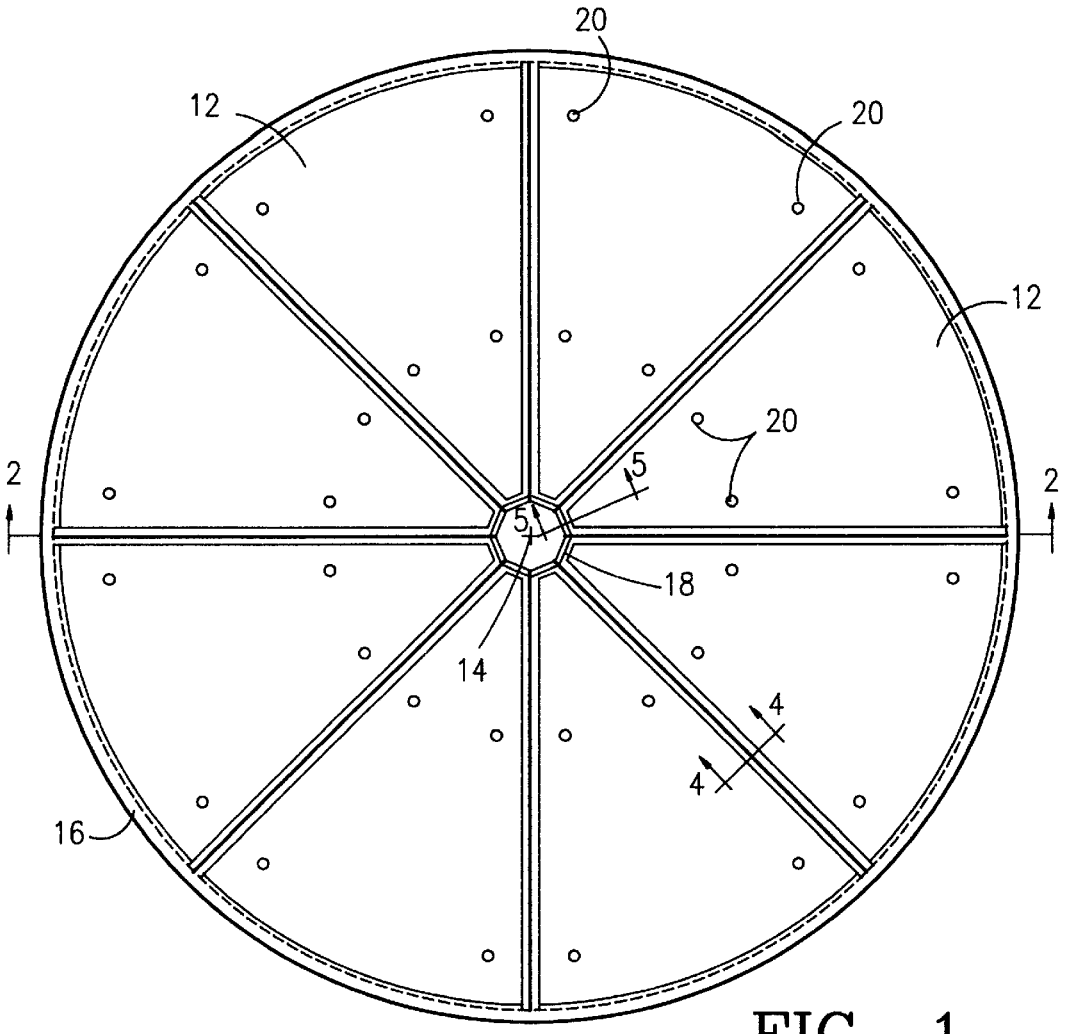
FIG. 1 is a plan view of a furnace lid according to one embodiment of the invention showing one form of the side panels and center panel.

Referring first to the assembled lid of FIGS. 1–4, eight side panels 12, each panel, when viewed from above, being substantially the sector of a circle having its origin at the center 14 of the lid. The side panels 12 extend outward toward a circular lid ring 16 extending around the lid. The side panels are disposed substantially concentric with the circular cylindrical furnace walls 17, side-by-side with their lateral edges abutting. The panels are inclined upwardly about 19 degrees toward the center, where a center panel 18, disposed horizontally, closes the lid surface. Panels 12 are castable refractory, preferably KRICON 30 XR or KRIFORM 30 XR low water vibrating castable commercially available from National Refractories & Materials, formed offsite by casting and transported to the construction site substantially ready for assembly.

Figure 10:
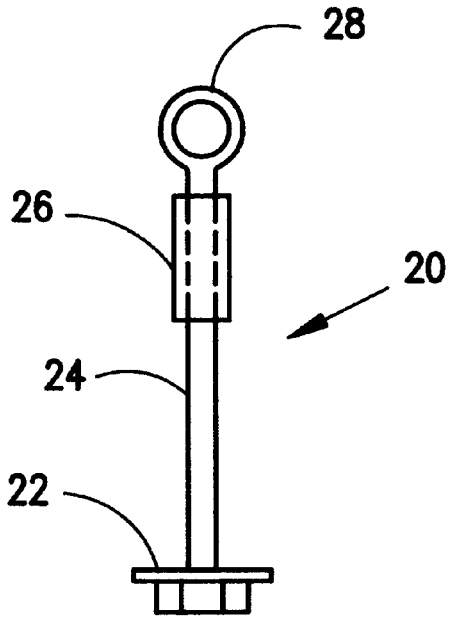
FIG. 10 is a side view of a lifting device.

Each side panel carries four lifting devices 20 located appropriately to support the panel and to provide means for carrying the panel from above by a cable suspended from a crane. The components of a suitable lifting device, detailed in FIG. 10, include a flat washer 22 located at the lower surface of the panel, a 1.0 inch diameter bolt 24 passing through the washer and extending about 10 inches into the thickness of the panel, a coupling nut 26 engaging the bolt threads and extending to the upper surface of the panel, and an eyebolt 28 engaging the coupling nut threads and extending above the panel.

The walls of the furnace support vertically each side panel at a lower planar surface 30 and the lid ring at a lower flange 32. Lid ring 16, a circular, water cooled ring, includes I-beam 34 and plate 36 welded to the beam. A ladle line 38, located between the web of the beam 34 and the circular arc that defines the outer periphery of each side panel, is cast against the lid ring after the panels have been positioned on the lid ring. The ladline is preferably made from a low iron castable refractory sold under the trademark LADELINE, commercially available from National Refractories & Materials.

Figure 4:
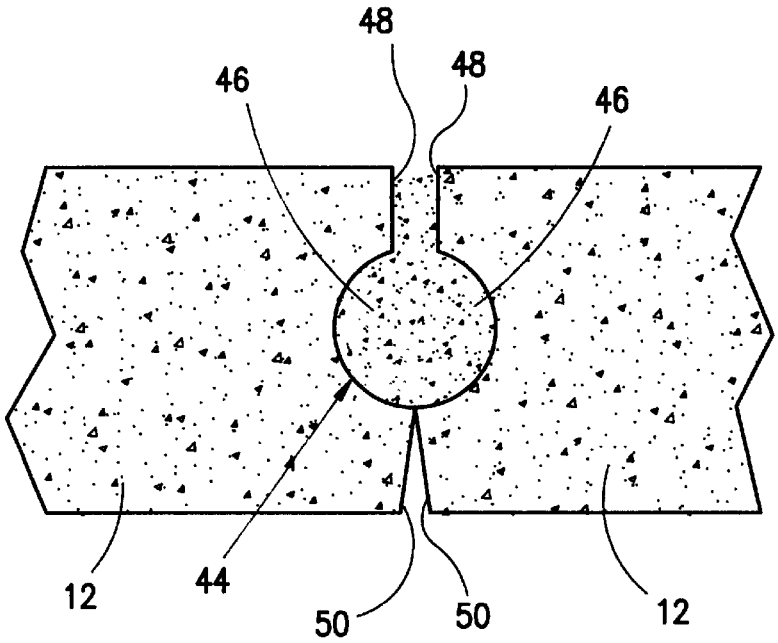
FIG. 4 is a cross section taken at plane 4—4 of FIG. 1 showing a keyway formed by adjacent side panels.

The radial or lateral edges 40 and inner edge 42 of each side panel are formed with a continuous, relatively large semicircular concave channel 46 centered near the midplane of the panel, and an access passage 48 connecting channel 46 and the upper surface of the panel. The lower surfaces of the channels, located about three-quarters of the thickness of the panel below the upper surface, are closed by abutting contact with the edges of the adjacent panel. As FIG. 4 shows, the lower edges of the panels are formed with beveled surfaces 50 to facilitate installation. When adjacent side panels are placed in position, the complementary channels 46 and passages 48 become aligned and form a keyway 44 accessible from the upper surface of the panels. Castable refractory, preferably KRICON 30 XR or KRIFORM 30 XR low water vibrating castable, is placed into the passages, flows into the channels, fills the channels and passages, dries, cures and hardens, thereby providing a structural connection among the side panels, referred to hereafter as keys 45.

Figure 2:
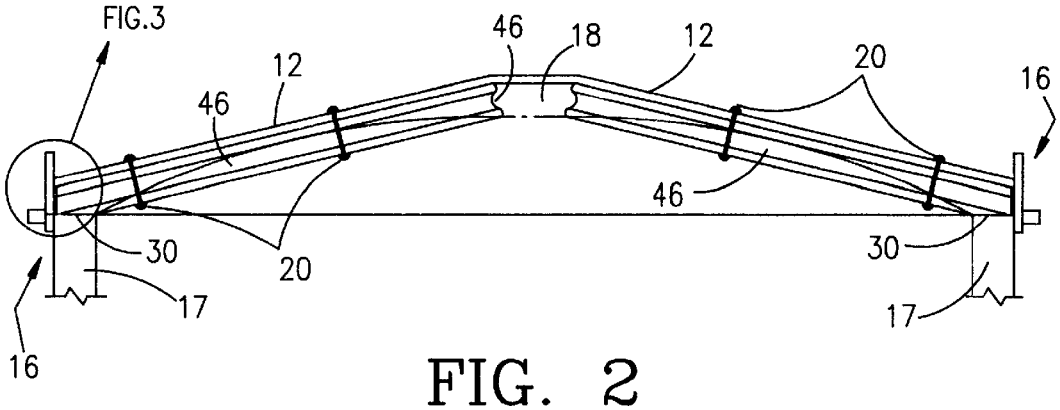
FIG. 2 is a cross section taken at plane 2—2 of FIG. 1.
Figure 3:
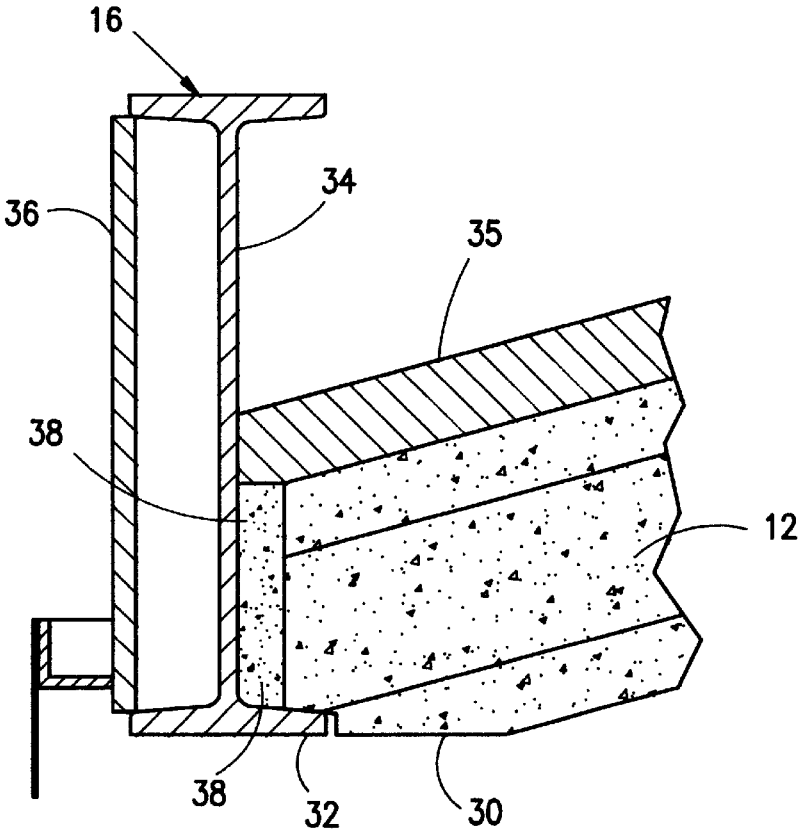
FIG. 3 is a detail showing the joint between the lid ring and side panels.

To support the side panels during assembly so that they become self supporting after assembly, a pedestal is placed inside the furnace at the center. A steel framework, vertically adjustable using a conventional eight ton screw jack, is located below each side panel. The water cooled lid ring is placed on top of the furnace walls and positioned for proper alignment by a crane used to lift the lid from the furnace. The eight side panels are positioned on the framework and the lid ring, as shown in FIG. 2. The ladle line 38 is cast against the lid ring and the side panels.

Figure 5:
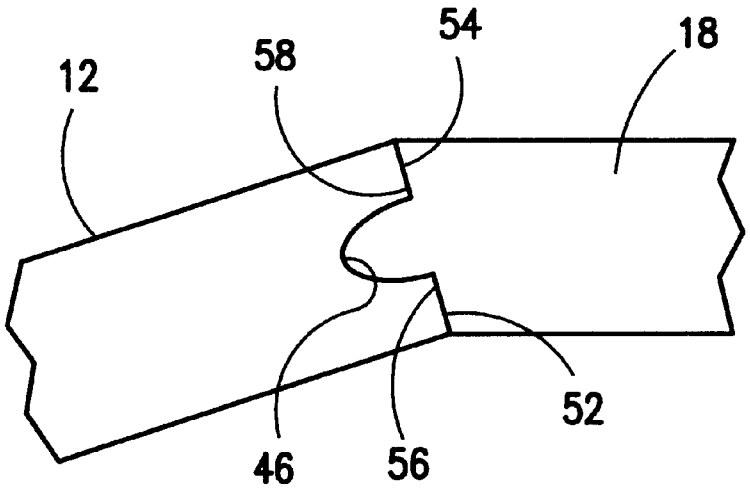
FIG. 5 is a cross section taken at plane 5—5 of FIG. 1 showing a keyway at the inner edge of a side panel and center panel.

Then the center panel is cast in place after locating a 1.0 inch thick plywood supporting panel immediately below the center panel. The material of the center panel is also KRICON 30 XR or KRIFORM 30 XR low water vibrating castable. FIG. 5 illustrates the joint between the center panel and each side panel. The center panel 18, a polygon in planform, has beveled edges 56, 58 which contact the inclined upper and lower inner edges 52, 54 of each side panel. Channel 46, at the inner edge of each side panel, is filled with the material of the center panel as it is cast in place. The castable refractory of the center panel is placed into the space above the supporting plywood platform and between the inner edges of the side panels. It flows into channel 46 fills the channel, dries, cures and hardens, thereby providing a structural connection among the side panels and center panel.

After the panels are set in place and the keyways are filled with keys 45, a three inch thickness of bulk castable thermal insulation 35, called VEE BLOCK MIX, commercially available from National Refractories & Materials, is cast over the entire upper surface of the panels.

The lid ring is attached to the lifting crane and the lid is raised vertically six inches. The framework supporting the individual center panels is raised two inches and the screw jack is removed. This permits the framework to collapse to a total height of four inches. The lid is removed and the pedestal and framework for each panel are removed using a building crane. The eyebolts of the four lifting devices are used to lift each side panel into position from ground level. After all the side panels are installed, the eyebolts are removed from the coupling nuts, and the holes are filled with moldable material and sealed.

FIG. 8 is a plan view of another furnace lid according to the invention showing six side panels and a circular center panel, concentric with the circular cylindrical walls 59 of the furnace. When viewed from above, each side panel 60 is a sector of a circle having its origin at the center of the lid and radii extending outward toward the ring 16 lid. The side panels are disposed side-by-side with lateral edges abutting. The panels are inclined upward toward the center, where a center panel 62, disposed horizontally and having beveled edges, closes the lid surface. The panels 60, 62 are of castable refractory, preferably KRIFORM 30 XR. Each panel is supported by lifting devices 20 to facilitate assembly on the furnace walls. A lid ring 16 is used to provide radial support to the inclined side panels, and the panels may be joined by keyways filled with castable refractory as described above with respect to the furnace lid of FIGS. 1–7.

During assembly, the panels are supported vertically by a framework 64 that spans the space across the diameter of the furnace walls. When all the panels that form the furnace lid are in place, the circular, arcuate inner edges of the side panels abut the outer edge of the center panel, thereby mutually supporting each other in dome-like fashion vertically on the upper surface of the furnace walls and radially against the lid ring 16.

Figure 11:
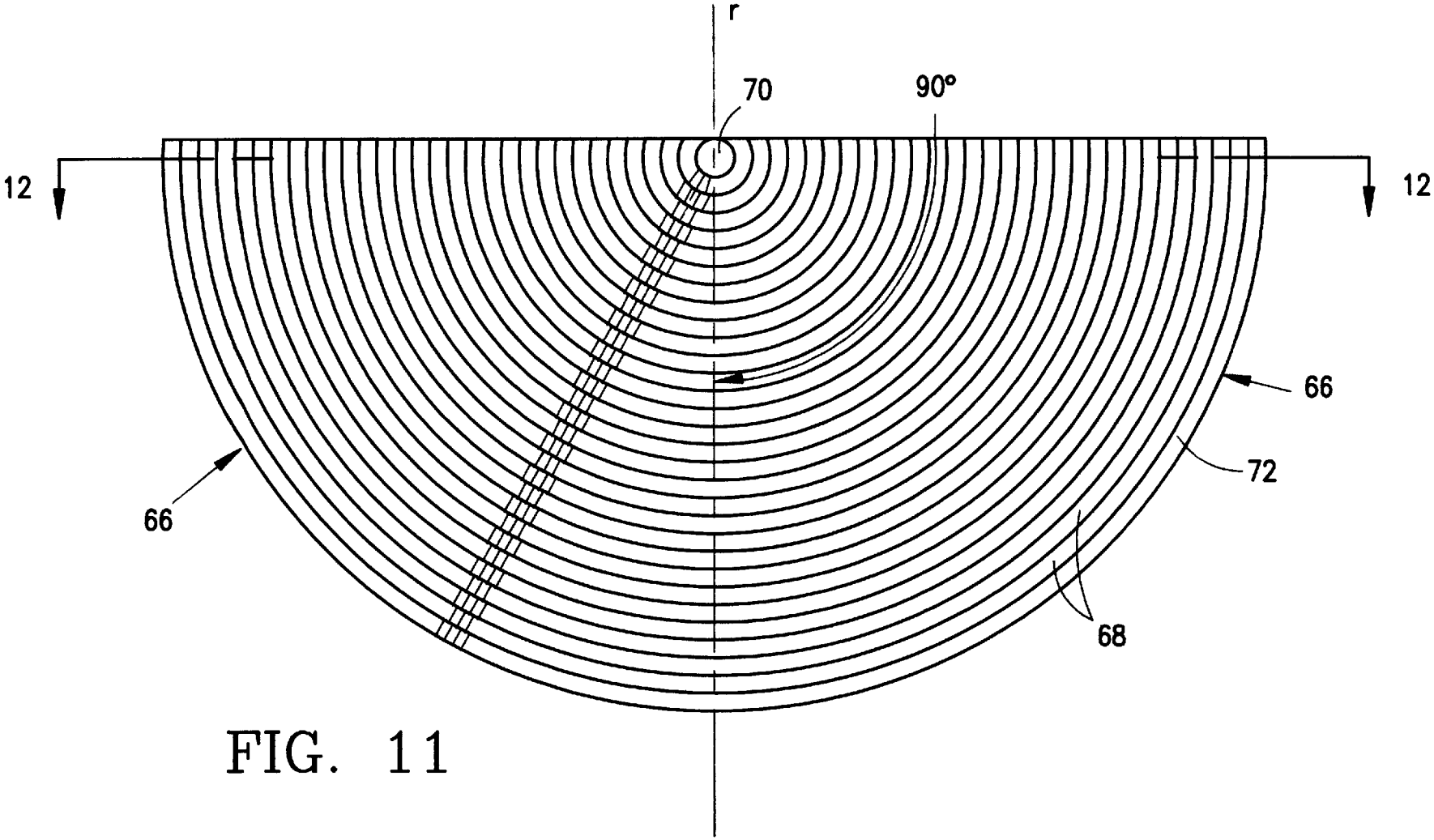
FIG. 11 is a partial plan view of still another a furnace lid according to this invention.
Figure 12:
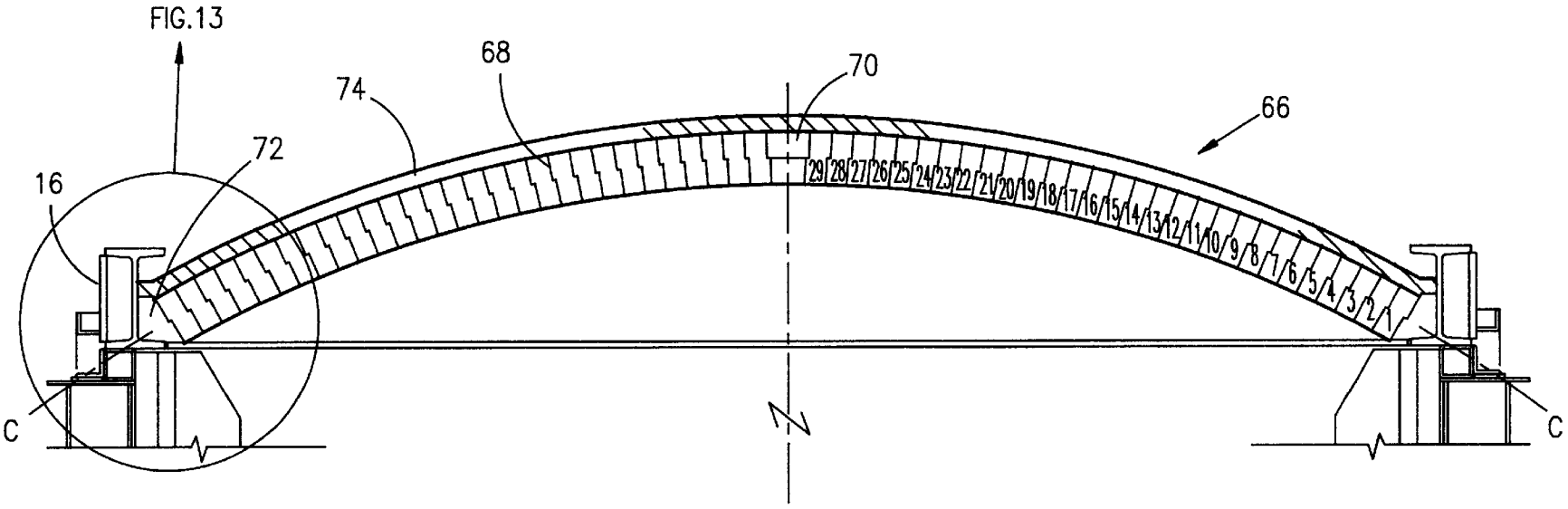
FIG. 12 is a cross section taken at plane 12—12 of FIG. 11.
Figure 13:
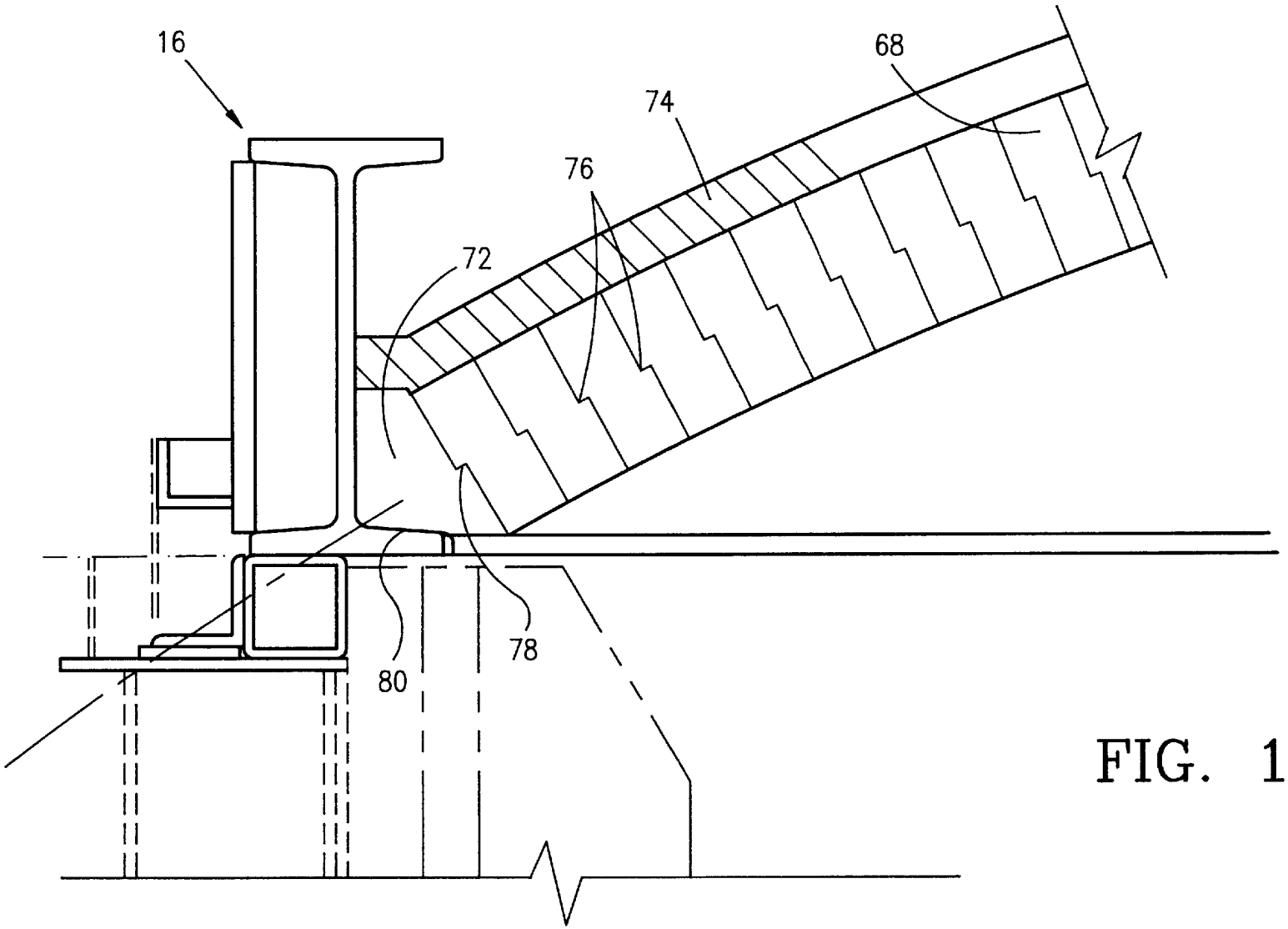
FIG. 13 is an enlarged view of detail A of FIG. 12.

Referring now to the further design of FIGS. 11–13, the furnace lid 66 preferably is configured as an arch (FIG. 12,)

along its full span FS, i.e., in the assembly shown in FIG. 12, the lid has a constant radius R to the center line CL. Such a configuration is referred to as a dome configuration.

The lid 66 comprises side panel blocks 18, a center panel block 70 and skewbacks 72. As in the other embodiments, the blocks and skewbacks are preferably made of castable refractory.

As shown in FIG. 12, the side panels are formed as segments of a circle. In the configuration shown, the side panels along with their corresponding skewbacks are formed as segments extending through a 90° angle. Alternatively, however, any angle can be used, such, for example, as those shown in FIGS. 1 and 8. In any case, each side panel segment includes a plurality of blocks 68 and a corresponding skewback 72, each having a complementary radius in the direction shown in FIG. 11. When assembled the individual blocks abut the blocks adjacent to them in the direction of the radius r, as well as those in adjacent panel segments.

The abutment in the direction of the radius r is shown in FIG. 13. Each block 68 includes spaced apart step portions 76, while each skewback includes step portions 78 and 80. The center panel block 70, like the skewbacks, includes a step portion. The step portions 76 and 78 are located substantially along the centerline CL. This centerline is known as the line of thrust, i.e., the line of force along which the arch distributes the vertical and horizontal elements of its weight. The step portions 76 and 78 act as restraints or locks which retain the various blocks in place. They serve also to transfer load to the skewbacks which in turn transfer the load to the lid ring 16. For this purpose each skewback is provided with a step portion 80.

In addition, at their edges, the blocks 68 and skewbacks 72 are preferably configured to form the keyways shown in FIG. 4 for receiving keys. Here also, the keys are made, preferably, of a castable refractory. Alternatively, the side surfaces of adjacent blocks 68 and skewbacks 72 can merely abut each other without forming a keyway.

As in the previous embodiments, a bulk castable thermal insulation 74 can be cast over the entire upper surface of the lid.

While several modes for carrying out the invention have been described in detail, those familiar with the relevant art will recognize various alternative designs and embodiments for practicing the invention defined by the following claims.

What is claimed is:

1. A furnace lid, comprising:

a center panel;

side panels surrounding the center panel, each side panel having an outer edge, an inner edge abutting the center panel and lateral edges each extending between their outer edge and their inner edge, and abutting a lateral edge of an adjacent side panel, said side panels being inclined upwardly from their outer edges toward their inner edges, forming with the center panel a lid having substantially a dome shape, the lateral edges and inner edges being formed with keyways accessible from a surface of the lid; and keys located in the keyways, wherein the center panel, keys and side panels are formed of castable refractory.

2. The lid of claim 1, wherein the keyways of the lateral edges of the side panels comprise:

channels located within the thickness of the side panels and extending along the lateral edges; and passages connecting the channels and an outer surface of the lid and extending along the lateral edges, and wherein the keys substantially fill the channels and passages.

3. The lid of claim 1, further comprising a lid ring fixed against displacement and encircling the side panels, the outer edge of the side panels contacting the lid ring.

4. The lid of claim 3, wherein the keyways of the inner edges of the side panels comprise a concave channel located within the thickness of the side panels and extending along the inner edge, and the center panel includes a key located in the concave channel.

5. The lid of claim 1, wherein the side panels are formed by casting before placement in position surrounding the center panel, and the keys and center panel are cast in position after the side panels are located in position surrounding the position of the center panel.

6. The lid of claim 1, further comprising castable bulk thermal insulation covering the upper surface of the side panels and center panel.

7. A lid for a circular cylindrical furnace, comprising:

a center panel disposed in a substantially horizontal plane, located concentrically with the furnace walls;

side panels surrounding the center panel, each side panel having an outer surface that is substantially a circular sector, an outer edge, an inner edge abutting the center panel and lateral edges, each extending between their outer edge and their inner edge, and abutting a lateral edge of an adjacent side panel, said side panels being inclined upwardly from their outer edges toward their inner edges, forming with the center panel a lid having substantially a dome shape, the lateral edges and inner edges being formed with keyways accessible from a surface of the lid; and keys located in the keyways, wherein the center panel, keys and side panels are formed of castable refractory.

8. The lid of claim 7, wherein the keyways of the lateral edges of the side panels comprise:

channels located within the thickness of the side panels and extending along the lateral edges; and passages connecting the channels and an outer surface of the lid and extending along the lateral edges, and wherein the keys substantially fill the channels and passages.

9. The lid of claim 7, further comprising a lid ring fixed against displacement and encircling the side panels, the outer edges of the side panels contacting the lid ring.

10. The lid of claim 8, wherein the keyways of the inner edges of the side panels comprise a concave channel located within the thickness of the side panels and extending along the inner edge, and the center panel includes a key located in the concave channel.

11. The lid of claim 7, wherein the side panels are formed by casting before placement in position surrounding the center panel, and the keys and center panel are cast in position after the side panels are located in position surrounding the position of the center panel.

12. The lid of claim 7, further comprising castable bulk thermal insulation covering the upper surface of the side panels and center panel.

13. A segment of a furnace lid comprising:

a substantially planar panel of precast refractory having an upper surface, a lower surface, lateral edges and an inner edge, wherein the lower surface has a portion inclined relative to the upper surface;

a concave channel extending along each lateral edge, located below the outer planar surface of the panel; and a relatively thin passage or recess formed along the lateral edges between an outer surface of the panel and the channel, connecting the channel and said outer surface of the panel.

14. The segment of claim 13, wherein the channel extends along each lateral edge and the inner edge, the channel being substantially aligned with a plane through the thickness of the panel.

15. The lid of claim 1, wherein the dome shape comprises a right circular truncated cone.

16. The lid of claim 7, wherein the dome shape comprises a right circular truncated cone.

17. The segment of claim 13, wherein the substantially planar panel further has an outer edge and a surface adjacent the outer edge for engaging the flange of a support beam.

18. The lid of claim 1, wherein each side panel further has a substantially planar surface adjacent its outer edge, and wherein each panel is supported at said substantially planar surface, its lateral edges and its inner edge.

19. The lid of claim 7, wherein each side panel further has a substantially planar surface adjacent its outer edge, and wherein each panel is supported at said substantially planar surface, its lateral edges and its inner edge.

20. A furnace lid, comprising:

a center panel block; and side panels surrounding the center panel block, each side panel including a skewback and a plurality of blocks extending from the skewback to said center panel block, said center panel block and skewbacks having a step portion and said plurality of blocks having spaced apart step portions, wherein in assembly, the step portions mutually engage, so that the center panel block and side panels form a substantially arch shape.

21. The lid of claim 20, further comprising a lid ring fixed against displacement and encircling the side panels, with the skewback in each side panel contacting the lid ring.

22. The lid of claim 20, further comprising castable bulk thermal insulation covering the upper surface of the side panels and center panel block.

23. The lid of claim 20, wherein the plurality of blocks and the skewback in each side panel define lateral edges which are formed with keyways accessible from a surface of the lid.

24. The lid of claim 23, further comprising:

keys located in the keyways, said keys being formed of castable refractory.

* * * * *